US007088056B2

(12) United States Patent
Kurachi et al.

(10) Patent No.: US 7,088,056 B2
(45) Date of Patent: Aug. 8, 2006

(54) BULB TYPE ELECTRODELESS FLUORESCENT LAMP

(75) Inventors: Toshiaki Kurachi, Osaka (JP); Kenji Itaya, Osaka (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 0 days.

(21) Appl. No.: 10/506,445

(22) PCT Filed: Jul. 28, 2003

(86) PCT No.: PCT/JP03/09520

§ 371 (c)(1),
(2), (4) Date: Sep. 1, 2004

(87) PCT Pub. No.: WO2004/012225

PCT Pub. Date: Feb. 5, 2004

(65) Prior Publication Data

US 2005/0168169 A1 Aug. 4, 2005

(30) Foreign Application Priority Data

Jul. 30, 2002 (JP) ..... 2002-221849

(51) Int. Cl.
*H05B 41/16* (2006.01)
*H01J 11/04* (2006.01)
*H01J 17/16* (2006.01)

(52) U.S. Cl. ..... 315/248; 315/344; 313/634

(58) Field of Classification Search ..... 315/56–57, 315/70, 248, 344; 313/567, 634, 637; H05B 41/16; H01J 11/04
See application file for complete search history.

(56) References Cited

U.S. PATENT DOCUMENTS

| | | | | |
|---|---|---|---|---|
| 4,727,294 | A * | 2/1988 | Houkes et al. | 315/248 |
| 5,461,284 | A * | 10/1995 | Roberts et al. | 315/57 |
| 5,668,433 | A * | 9/1997 | Everest et al. | 313/313 |
| 5,698,951 | A * | 12/1997 | Maya et al. | 315/248 |
| 5,808,414 | A | 9/1998 | Wharmby et al. | 313/607 |
| 5,811,914 | A | 9/1998 | Eijkens | 313/51 |
| 5,903,109 | A | 5/1999 | Van Gennip et al. | 315/248 |
| 6,768,254 | B1 * | 7/2004 | Arakawa et al. | 313/493 |
| 6,781,315 | B1 * | 8/2004 | Nishio et al. | 315/56 |

FOREIGN PATENT DOCUMENTS

| | | |
|---|---|---|
| JP | 07-282784 | 10/1995 |
| JP | 10092391 A | 4/1998 |
| JP | 11102667 A | 4/1999 |

OTHER PUBLICATIONS

International Search Report for PCT/JP03/09520, Mailed Sep. 2, 2003; ISA/JPO.

* cited by examiner

*Primary Examiner*—Thuy Vinh Tran
(74) *Attorney, Agent, or Firm*—Harness, Dickey & Pierce, P.L.C.

(57) ABSTRACT

A connection wire 110 extends from an end of an induction coil 109, along a surface of a base portion 104*b* of a bobbin 104, which surface is located close to a luminous bulb 101. The connection wire 110 is separated from a sealing portion 118 of an inner tube 120 and an outertube 119.

11 Claims, 6 Drawing Sheets

BULB TYPE ELECTRODELESS FLUORESCENT LAMP

This Application is a National Phase Application under 35 U.S.C. 371 claiming the benefit of PCT/JP03/09520 filed on Jul. 28, 2003, which has priority based on JAPAN Application No. 2002-221849 filed on Jul. 30, 2002.

TECHNICAL FIELD

The present invention relates to self-ballasted electrodeless fluorescence, and more particularly relates to self-ballasted electrodeless fluorescent lamps that can directly replace incandescent lamps.

BACKGROUND ART

Recently, in view of global environmental protection and cost effectiveness, self-ballasted fluorescent lamps with electrodes, which have about five times higher efficacy than that of incandescent lamps, have been widely used as substitutes for incandescent lamps in houses, hotels and other places. In addition to the already existing self-ballasted fluorescent lamps with electrodes, self-ballasted electrodeless fluorescent lamps have also been studied in recent years. A feature of electrodeless fluorescent lamps is that they have a longer life than fluorescent lamps with electrodes, owing to the absence of electrode. Electrodeless fluorescent lamps are thus expected to become widespread in the future.

Such a self-ballasted electrodeless fluorescent lamp is disclosed in Japanese Laid-Open Publication No. 10-92391, for example. The self-ballasted electrodeless fluorescent lamp disclosed in the publication is illustrated in FIG. 6.

The self-ballasted electrodeless fluorescent lamp 200 of FIG. 6 has as the entire device the shape of an incandescent lamp. More specifically, the lamp 200 is composed of a translucent discharge vessel 201, a coil 203 inserted in a cavity portion 201*a* of the discharge vessel 201, and a power supply circuit 204 for supplying alternating current to the coil 203. The coil 203 is made up of a rod-shaped ferrite core and a winding. The winding is connected to the power supply circuit 204. The power supply circuit 204 is formed and vertically placed on a circuit board on which a rectifier and a RF oscillator are provided in a vertical direction in the figure. The power supply circuit 204 is covered with a plastic case 205. Input power to the power supply circuit 204 is supplied via a base 207 provided on part of the case 205.

Mercury amalgam 206 and argon are enclosed as luminous substance in the discharge vessel 201, while a phosphor layer 202 is formed on the inner surface of the discharge vessel 201. The phosphor layer 202 changes ultraviolet light produced in the discharge vessel 201 into visible light.

However, to use electrodeless fluorescent lamps as substitutes for incandescent lamps, it is required to make the electrodeless fluorescent lamps closer to the incandescent lamps in terms of outer appearance and size. When a circuit board is placed vertically as in the above-mentioned disclosed electrodeless fluorescent lamp, it is difficult for the lamp to have an outer appearance and a size close to those of an incandescent lamp. Thus, in order to make the entire size almost equal to that of an incandescent lamp and then place the circuit board therein, the circuit board is preferably placed horizontally. In view of this, the present inventors have made an electrodeless fluorescent lamp in which a circuit board is placed horizontally and which is equal in size to an incandescent lamp.

The present inventors made various experiments using the lamp with the horizontally placed circuit board, and consequently found that when the lamp is operated, blackening is caused near the opening of the cavity portion of the discharge vessel and that the mercury reacts with the vessel wall and is consumed. Such blackening becomes particularly severe when a phosphor, a protective coating, or the like is not applied. The fact that blackening occurs in an inner tube around the winding of an induction coil has been conventionally known as disclosed in Japanese Laid-Open Patent Publication No. 11-102667. However, the fact that blackening occurs in the vicinity of the opening of the cavity portion was found by the present inventors for the first time. The mechanism behind the occurrence of blackening of the inner tube around the winding was that a high electric field, resulting from a potential difference between adjacent turns of the winding, causes ions or the like in plasma to be attracted to, and come into collision with, the tube wall. On the other hand, the blackening occurring near the opening of the cavity portion, which was found by the present inventors, is caused in the vicinity of a connection wire that extends from the coil, and cannot be explained by the mechanism disclosed in the above-mentioned publication, because there are no such adjacent turns. If such blackening occurs, the mercury is held in the blackened portion, which causes the problem that the quantity of mercury in the discharge gas decreases over the course of time, so that the quantity of emitted light is reduced. Nevertheless, since the mechanism behind such blackening is unknown, countermeasures cannot be taken easily.

In view of these circumstances, the present invention was made, and an object thereof is to provide a self-ballasted electrodeless fluorescent lamp in which no blackening occurs near the opening of a cavity portion of a discharge vessel.

DISCLOSURE OF INVENTION

A first inventive self-ballasted electrodeless fluorescent lamp includes: a luminous bulb in which a luminous gas containing at least mercury is enclosed and which has a cavity portion; an induction coil inserted in the cavity portion; a circuit board electrically connected to the induction coil; a case in which the circuit board is placed; and a base attached to the case and electrically connected to the circuit board, wherein a ballast circuit for supplying high frequency power to the induction coil is formed on the circuit board; the luminous bulb includes an approximately spherical outer tube and an inner tube defining the cavity portion; the circuit board is placed approximately horizontally when a central axis of the inner tube is placed vertically; a connection wire for electrically connecting the induction coil and the circuit board extends from one end of the induction coil into a region beyond an outer edge of the cavity portion, and is connected to the circuit board; and the connection wire is placed so as to be spaced apart from a sealing portion of the outer and inner tubes.

The self-ballasted electrodeless fluorescent lamp preferably further includes: a bobbin including a winding rod, around which the induction coil is wound, and a base portion, which is placed approximately at a right angle with respect to the winding rod and which supports the winding rod. And, preferably, the winding rod of the bobbin is inserted in the cavity portion; the base portion of the bobbin is disposed between the luminous bulb and the circuit board; and the connection wire extends from the one end of the induction coil so as to pass on or above a surface of the base portion which is located close to the luminous bulb.

In the self-ballasted electrodeless fluorescent lamp, part of the case preferably supports part of the luminous bulb, and the structure in which the connection wire is disposed spaced apart from the sealing portion is preferably realized by lifting with the case the luminous bulb in a direction opposite to the base.

In the self-ballasted electrodeless fluorescent lamp, an upper end of the case preferably supports part of the luminous bulb in such a manner as to lift the luminous bulb in a direction opposite to the base, thereby allowing the connection wire to be disposed spaced apart from the sealing portion.

In the self-ballasted electrodeless fluorescent lamp, a protrusion, which supports part of the luminous bulb in such a manner as to lift the luminous bulb in a direction opposite to the base, is preferably formed on the base portion, which allows the connection wire to be disposed spaced apart from the sealing portion In the self-ballasted electrodeless fluorescent lamp, a film capacitor, which is a circuit element included in the ballast circuit, is preferably disposed on a surface of the circuit board which is located close to the base A second inventive self-ballasted electrodeless fluorescent lamp includes: a luminous bulb in which a luminous gas containing at least mercury is enclosed and which has a cavity portion; an induction coil inserted in the cavity portion; a circuit board electrically connected to the induction coil; a case in which the circuit board is placed; and a base attached to the case and electrically connected to the circuit board, wherein a ballast circuit for supplying high frequency power to the induction coil is formed on the circuit board; the luminous bulb includes an outer tube and an inner tube defining the cavity portion; the circuit board is provided with output terminals to the induction coil and input terminals from the base; the output and input terminals are disposed so as to be separate from each other by 15 mm or more; a connection wire for electrically connecting the induction coil and the circuit board extends from one end of the induction coil into a region beyond an outer edge of the cavity portion, and is connected to the circuit board; and the connection wire is placed so as to be spaced apart from a sealing portion of the outer and inner tubes.

In one preferred embodiment, the connection wire and the sealing portion are spaced apart from each other by 0.3 mm or more.

In one preferred embodiment, the greatest length of the circuit board is 60 mm or less.

A phosphor or a protective coating is not applied to an inner wall of the sealing portion.

BEST MODE FOR CARRYING OUT THE INVENTION

Figure 1:
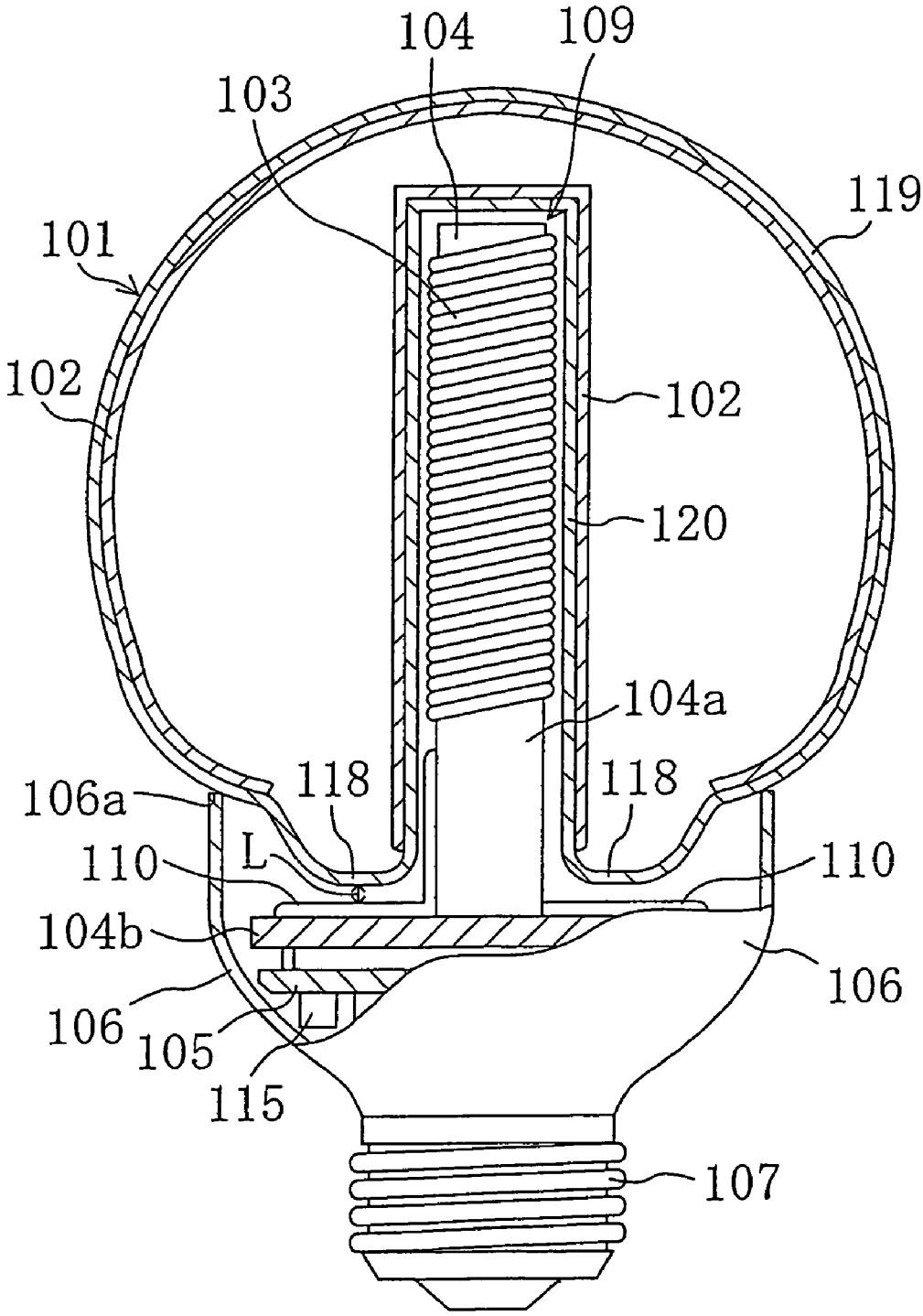
FIG. 1 is a partially cutaway view of a self-ballasted electrodeless fluorescent lamp in accordance with a first embodiment.

Hereinafter, embodiments of the present invention will be described with reference to the accompanying drawings. In the drawings, members that have substantially the same function will be identified by the same reference numerals for the sake of simplicity. The present invention is not limited to the following embodiments.

(First Embodiment)

FIG. 1 is a partially cutaway view of a self-ballasted electrodeless fluorescent lamp in accordance with a first embodiment. The self-ballasted electrodeless fluorescent lamp illustrated in FIG. 1, to which electric power can be supplied via the base, includes a ballast circuit.

The self-ballasted electrodeless fluorescent lamp includes a luminous bulb (bulb) 101 having a cavity portion (cavity), an induction coil 109 inserted in the cavity portion 120, a circuit board 105 electrically connected to the induction coil 109, a case 106 in which the circuit board 105 is placed, and a base 107 electrically connected to the circuit board 105. In the luminous bulb 101, a luminous gas containing at least mercury is enclosed. The base 107 is attached to the case 106. The luminous bulb 101, the induction coil 109, the circuit board 105, the case 106, and the base 107 are integrated into one unit.

The induction coil 109 functions as a high frequency electromagnetic field generating means for generating a high frequency electromagnetic field within the luminous bulb 101. The induction coil 109 is composed of a core (not shown) made of soft magnetic material (ferrite, for example) and a coil (excitation coil) 103 wound around the core. In this embodiment, the core is placed within a cylindrical winding rod 104*a* of a bobbin 104, and the excitation coil 103 is also wound around the winding rod 104*a*. The coil 103 of the induction coil 109 is electrically connected to the circuit board 105 via a connection wire 110. On the circuit board 105, a ballast circuit for supplying high frequency power to the induction coil 109 is formed.

In this embodiment, the luminous bulb 101 is composed of a substantially spherical outer tube 119 and an inner tube 120 that defines the cavity portion. The inner tube 120 is approximately cylindrical and has an opening in vicinity to the circuit board 105. The outer tube 119 is in the shape of a so-called eggplant-shape. Examples of such a shape include the A-shape defined in JIS C 7710-1988.

As shown in FIG. 1, the connection wire 110 is disposed spaced apart from a sealing portion 118 of the outer and inner tubes 119 and 120. The luminous bulb 101 is supported by an upper end 106*a* of the case 106, which is the end opposing the base 107. The case's upper end 106*a* brings the luminous bulb 101 upward in such a manner that the connection wire 110 extending along the base portion 104*b* of the bobbin 104 is spaced apart from the sealing portion 118 of the outer and inner tubes 119 and 120. In this embodiment, the connection wire 110 extends from an end of the excitation coil 103 and is part of the excitation coil 103. However, the connection wire 110 is not limited to being part of the excitation coil 103 in this manner, but a conductive member such as a copper wire, a copper sheet, or a corrosion-inhibitor-plated copper sheet may be used. In that case, such a connection wire may be electrically connected with the excitation coil 103.

In this embodiment, the connection wire 110 is disposed spaced apart from the sealing portion 118 in order to prevent blackening of the inner wall of the sealing portion 118. Although mechanisms behind the occurrence of such blackening have not been elucidated sufficiently, the present inventors' thinking concerning the mechanisms is as follows. More specifically, if the connection wire 110 is in contact with the sealing portion 118, a potential difference occurring during lamp operation between plasma within the luminous bulb 101 and the connection wire 110 causes ions in the plasma to be attracted toward the connection wire 110 and then react with the material of the luminous bulb 101 to form mercury amalgam, thereby resulting in blackening. This is presumably due to the fact that the connection wire 110 is located too close to, and thus in contact with, the sealing portion 118, because of the circuit design of the horizontally placed circuit board 105, as will be described later. The problem of blackening can thus be solved by separating these members from each other. It would be considered that coating the inner wall of the luminous bulb 101 with a protective coating or a phosphor for suppressing the mercury reaction could prevent the blackening easily. However, since the sealing portion 118 is a portion in which the glasses fuse together, such a coating cannot be applied to the inner wall of the sealing portion 118. Therefore, it is presumed that if the sealing portion 118 and the connection wire 110 are not separate from each other unlike in this embodiment, the sealing portion 118 will be easily blackened. The protective coating mentioned in this embodiment includes alumina particles, for example. Alumina particles suppress sodium diffusion from the glasses to react with the mercury.

Next, the structure of this embodiment will be further described in detail. The luminous bulb 101 is a vessel made of glass in which mercury as luminous material and a rare gas (e.g., krypton or argon) as a buffer gas are enclosed. The mercury, which is enclosed in the luminous bulb 101 in a liquid form or as amalgam, is heated by plasma produced during lamp operation, and the luminous bulb 101 has a mercury vapor pressure defined by that temperature. The internal volume of the luminous bulb 101 is, for example, from 100 to 270 $cm^3$. In the luminous bulb 101, the mercury is enclosed in an amount of 2 to 10 mg, and the krypton is enclosed at a charged pressure of 50 to 300 Pa (at a temperature of 25° C.)

A phosphor 102 for converting ultraviolet light produced by discharge within the luminous bulb 101 into visible light is applied to the inside (the inner wall) of the luminous bulb 101. As described above, the inner tube 120 that is the cavity portion, into which part (i.e., the induction coil) of the high frequency electromagnetic field generating means is inserted, is formed in part of the luminous bulb 101. It is thus easy to dispose the high frequency electromagnetic field generating means near the luminous bulb 101. The luminous bulb 101 is formed of the cylindrical inner tube 120, in which the excitation coil 103 can be disposed, and the approximately spherical outer tube 119 with the phosphor 102 applied thereto. The outer edge of the cavity portion of the inner tube 120 is melted with flame from a burner or the like and fused to part of the outer tube 119. This fused portion is the sealing portion 118, and the phosphor 102 is not applied to the sealing portion 118. Since the fusing of this portion is carried out in the last stage of the fabrication of the luminous bulb 101, it is not possible to apply the phosphor 102.

Exemplary dimensions or the like of the luminous bulb 101 of this embodiment are as follows. The outer diameter of the central portion of the luminous bulb 101 (that is, the outer diameter of the greatest portion) is from 50 to 90 mm (thickness: about 1 mm). The luminous bulb 101 is made of soda lime glass, for example, but may be made of borosilicate glass or the like. The height of the luminous bulb 101 and the height of the electrodeless fluorescent lamp including the base 107 are, for example, from 60 to 80 mm, and from 130 to 240 mm, respectively. The inner diameter of the inner tube 120 of the luminous bulb 101 is, for example, from 16 to 26 mm.

The ballast circuit connected to the excitation coil 103 located in the inner tube 120 supplies high frequency power to the excitation coil 103. In other words, the ballast circuit is a high frequency power supply. In this embodiment, the high frequency electromagnetic field generating means is composed of the high frequency power supply, the ferrite core, and the excitation coil 103 wound around the ferrite core. As shown in FIG. 1, to produce discharge in the luminous bulb 101, the high frequency electromagnetic field generating means (in particular, the excitation coil 103 and the ferrite core) is provided in substantially the central portion of the luminous bulb 101. More specifically, the ferrite core and the excitation coil 103 wound around the bobbin 104 are inserted in the inner tube 120 of the luminous bulb 101. The circuit board 105, on which the high frequency power supply (ballast circuit) is formed, is placed in the case 106, and power is supplied from an external device via the base 107. The base 107 is structured so as to be screwed into a socket, so that just screwing the base 107 into a socket allows the electrodeless fluorescent lamp to be electrically connected to an external power supply (for example, commercial power.) Moreover, not only the electrodeless fluorescent lamp can be used just by screwing the base into a socket, but also the size and outer appearance of the lamp are close to those of an incandescent lamp. The electrodeless fluorescent lamp can therefore be put to the same uses as an incandescent lamp, and thus can directly replace an incandescent lamp.

The bobbin 104 is composed of the winding rod 104*a* and the base portion 104*b*. The excitation coil 103 of the induction coil 109 is wound around the winding rod 104*a*. The base portion 104*b* is disposed substantially at a right angle to the winding rod 104*a* and supports the winding rod 104*a*. The winding rod 104*a* has a cylindrical shape and is inserted into the inner tube 120, which is the cavity portion. The base portion 104*b* extends from an end of the winding rod 104*a* located close to the base 107, substantially at a right angle with respect to the winding rod 104*a*, so as to have the shape of a disc. The base portion 104*b* is positioned between the luminous bulb 101*a* and the circuit board 105. The base portion 104*b* is disposed approximately horizontally, when the central axis of the inner tube 120 is placed vertically.

The circuit board 105 is typically a printed circuit board. In this embodiment, like the base portion 104*b* of the bobbin 104, the circuit board 105 is disposed substantially horizontally when the central axis of the inner tube 120 is placed vertically. The base portion 104*b* and the circuit board 105 are substantially parallel to each other. The space in the case 106 is divided into two by the circuit board 105. The space on the circuit board 105 which is closer to the luminous bulb 101 is in close vicinity to high-temperature plasma in the luminous bulb 101, and thus has a higher temperature than the space under the circuit board 105 which is close to the base 107. Therefore, on the surface of the circuit board 105 which is close to the luminous bulb 101, relatively high-temperature-resistant circuit elements such as resistors are provided, while on the surface thereof close to the base 107, low heat-resistant circuit elements such as a film capacitor 115 are disposed. The circuit elements provided on both surfaces and circuit wiring formed on the circuit board 105 form the ballast circuit. The reason why the film capacitor 115 is used as a capacitor is that as compared with a ceramic capacitor, change in the capacitance of the film capacitor 115 with temperature is smaller, and the film capacitor 115 produces a smaller amount of heat because its resistance is lower.

The connection wire 110, which electrically connects the induction coil 109 and the circuit board 105, extends from the one end of the induction coil 109 into a region beyond the outer edge of the cavity portion, and is connected to the circuit board 105. More specifically, the connection wire 110 extends from the lower end of the excitation coil 103 of the induction coil 109, along the winding rod 104*a* to the base 107, and then extends along the surface of the base portion 104*b* which is located close to the luminous bulb 101, in a direction going away from the central axis of the luminous bulb 101 (this central axis substantially agrees with the central axis of the inner tube 120). The connection wire 110 then passes through the base portion 104*b* near the outer edge of the base portion 104*b*, and then extends to the circuit board 105 for connection with the circuit board 105. In this embodiment, the region beyond the outer edge of the cavity portion is a region which is located farther away from the central axis of the inner tube 120 than the edge of the opening of the inner tube 120 is. More specifically, an example of such a region may be the sealing portion 118. The connection wire 110 is disposed so as to separate from the sealing portion 118 of the outer and inner tubes 119 and 120. A distance L between the connection wire 110 and the outer surface of the sealing portion 118 is 0.5 mm. The distance L is preferably equal to or greater than 0.3 mm, and more preferably, the distance L is 0.5 mm or greater, in which case blackening can be prevented more reliably. Furthermore, it is preferable that insulating, high heat-resistant silicon or the like be applied to the gap between the connection wire 110 and the sealing portion 118, because the distance L can then be reliably obtained.

The connection wire 110 extends along the base portion 104*b* surface close to the luminous bulb 101 in the direction going away from the central axis of the luminous bulb 101. Another structure would be considered, in which the connection wire 110 extending along the winding rod 104*a* would pass through the base portion 104*b* where the connection wire 110 reaches the base portion 104*b*, and then would extend along the surface of the base portion 104*b* which is close to the circuit board 105, in a direction going away from the central axis of the luminous bulb 101. However, this structure is not desirable because of the following reasons. On the circuit board 105 surface close to the base portion 104*b*, there are the circuit wiring, the circuit elements, and protrusions of terminals of the circuit elements disposed on the opposite surface thereof. The connection wire 110 may thus be in contact with those members to be short-circuited or discharge.

Figure 3:
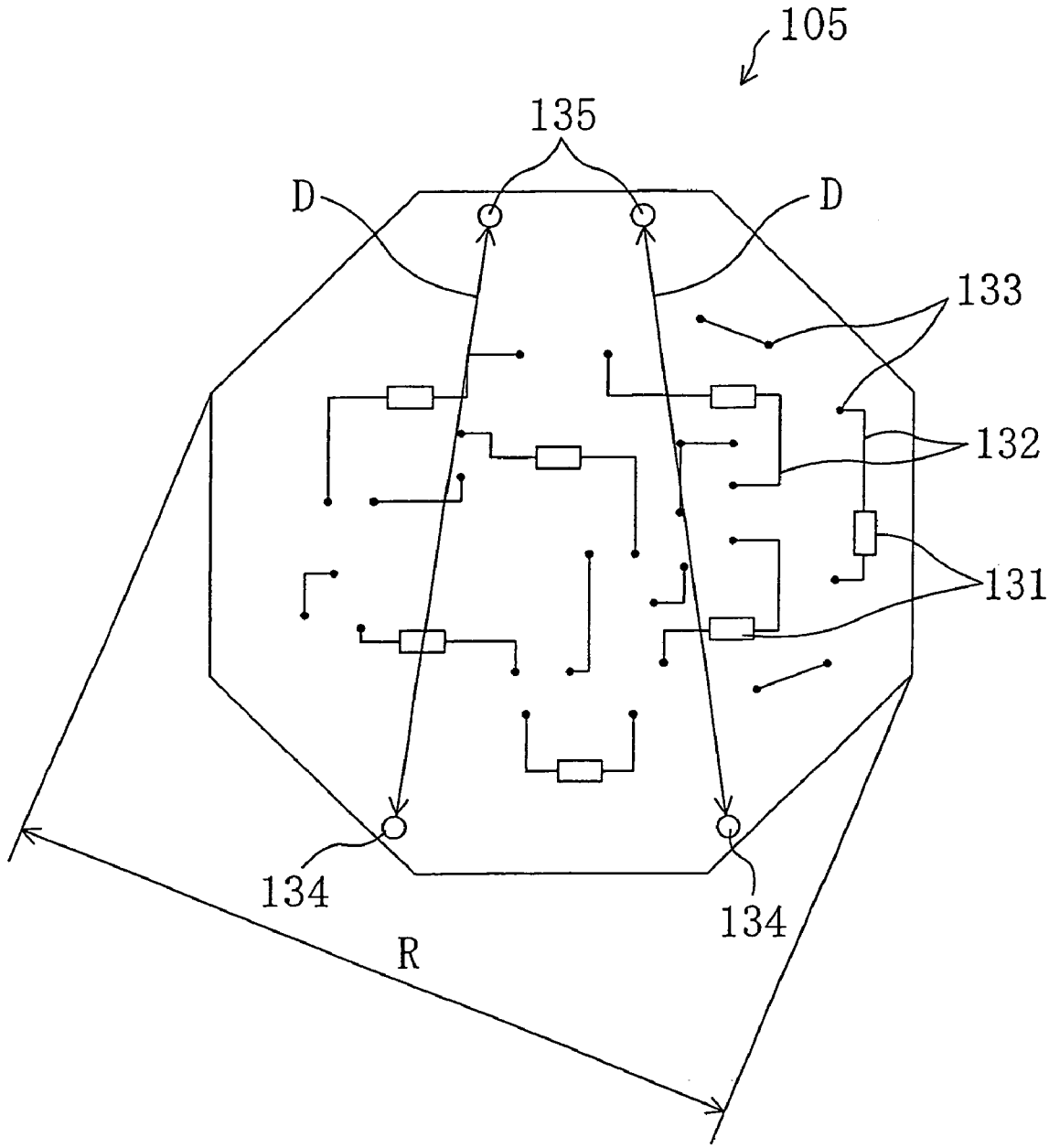
FIG. 3 is a view illustrating a circuit board surface that is located close to a luminous bulb in accordance with the first embodiment.

FIG. 3 schematically illustrates the circuit board 105 surface that is located close to the luminous bulb 101. The circuit board 105 is an octagonal sheet, and its greatest length R is 45 mm. The greatest length R is the greatest length within the face on which the ballast circuit is formed. The greatest length R, which is normally represented as the diameter of the circumscribed circle of the circuit board 105, is preferably 60 mm or less, so that the circuit board 105 can be horizontally placed within the case 106. The circuit board 105 may be round or rectangular in shape. Circuit elements 131, 131, . . . such as resistors are disposed on the surface of the circuit board 105, and connected via circuit wires 132, 132, . . . to the terminals 133, 133, . . . of circuit elements formed on the opposite surface. Two output terminals 134, 134 to the induction coil 109, that is, connection portions to the connection wire 110, are formed spaced apart from each other in the vicinity of the outer edge of the circuit board 105. Input terminals 135, 135 from the base 107 are formed substantially opposing the output terminals 134, 134 with the center of the circuit board 105 between. A distance D between the output terminals 134, 134 and the input terminals 135, 135 is 23 mm. The distance D is preferably 15 mm or more.

The greater the distance D becomes the better, because if the output wiring to the induction coil 109 is located near the input wiring from a commercial power, high frequency noise will be sent to the commercial power. However, the size of the circuit board 105 is limited, and that size determines an upper limit.

Moreover, another constraint that the design of the ballast circuit is subject to is that the output wiring, to which high voltage is applied, should be disposed as far as possible away from the other wires. Due to this constraint, the output terminals 134, 134, which are the connection portions with the connection wire 110 to the induction coil 109, are provided at the edge of the horizontally placed circuit board 105. The connection wire 110 thus extends toward the cavity portion, from the edge of the circuit board 105 that is adjacent to the case 106, and would be in contact with the sealing portion 118, if no countermeasure is taken. In view of this, in this embodiment, the luminous bulb 101 is lifted with the case's upper end 106*a* to allow the connection wire 110 to extend along the bobbin's base portion 104*b* so as to be spaced apart from the sealing portion 118, thereby preventing blackening of the sealing portion.

The case 106 is made of heat-resistant material, and in this embodiment the case 106 is made of heat-resistant resin (for example, poly-butylene terephthalate). The case 106 can be made of material having excellent thermal conductivity (for example, metal) to have increased heat dissipation characteristics.

Figure 4:
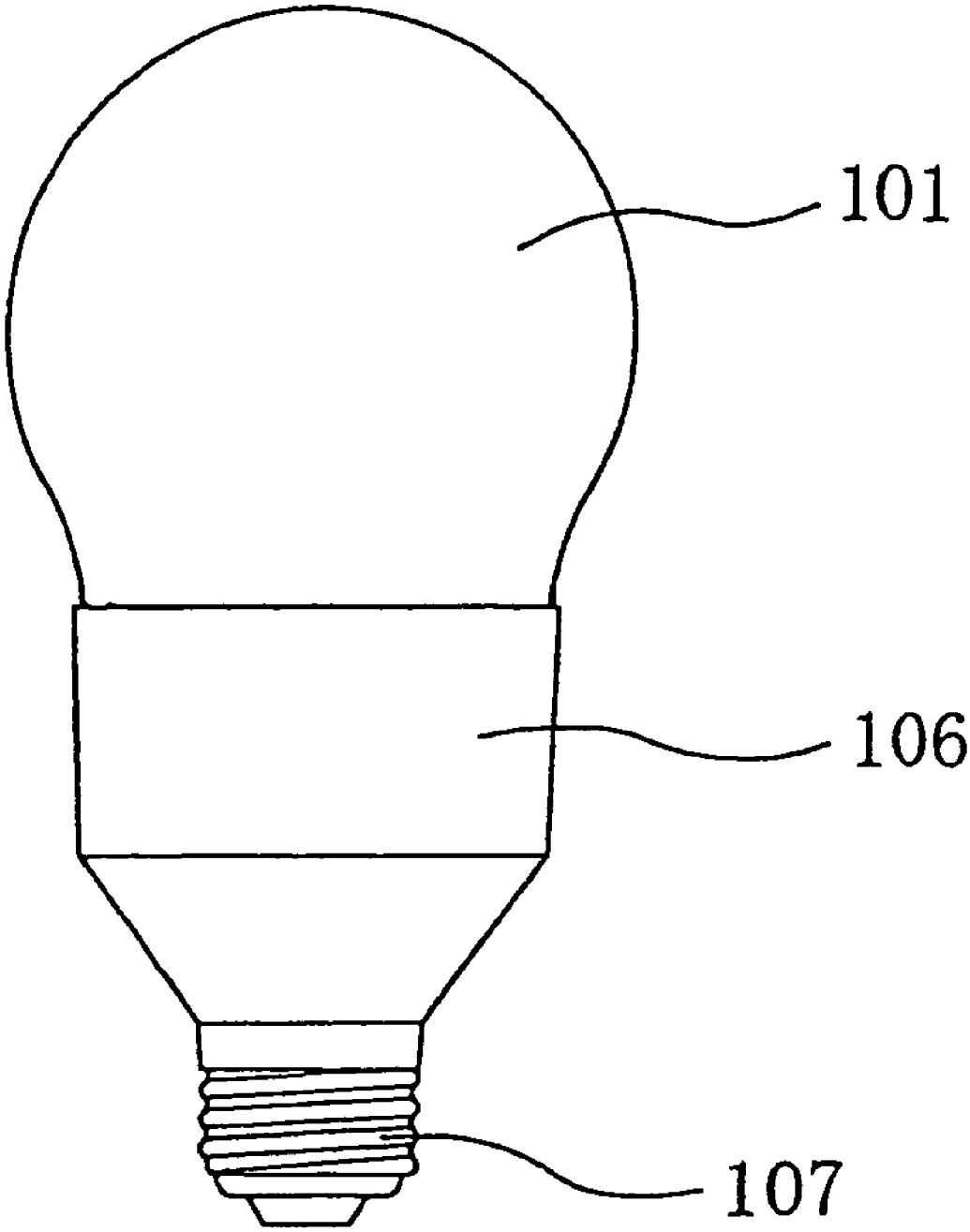
FIG. 4 illustrates the external appearance of the self-ballasted electrodeless fluorescent lamp of the first embodiment.
Figure 5:
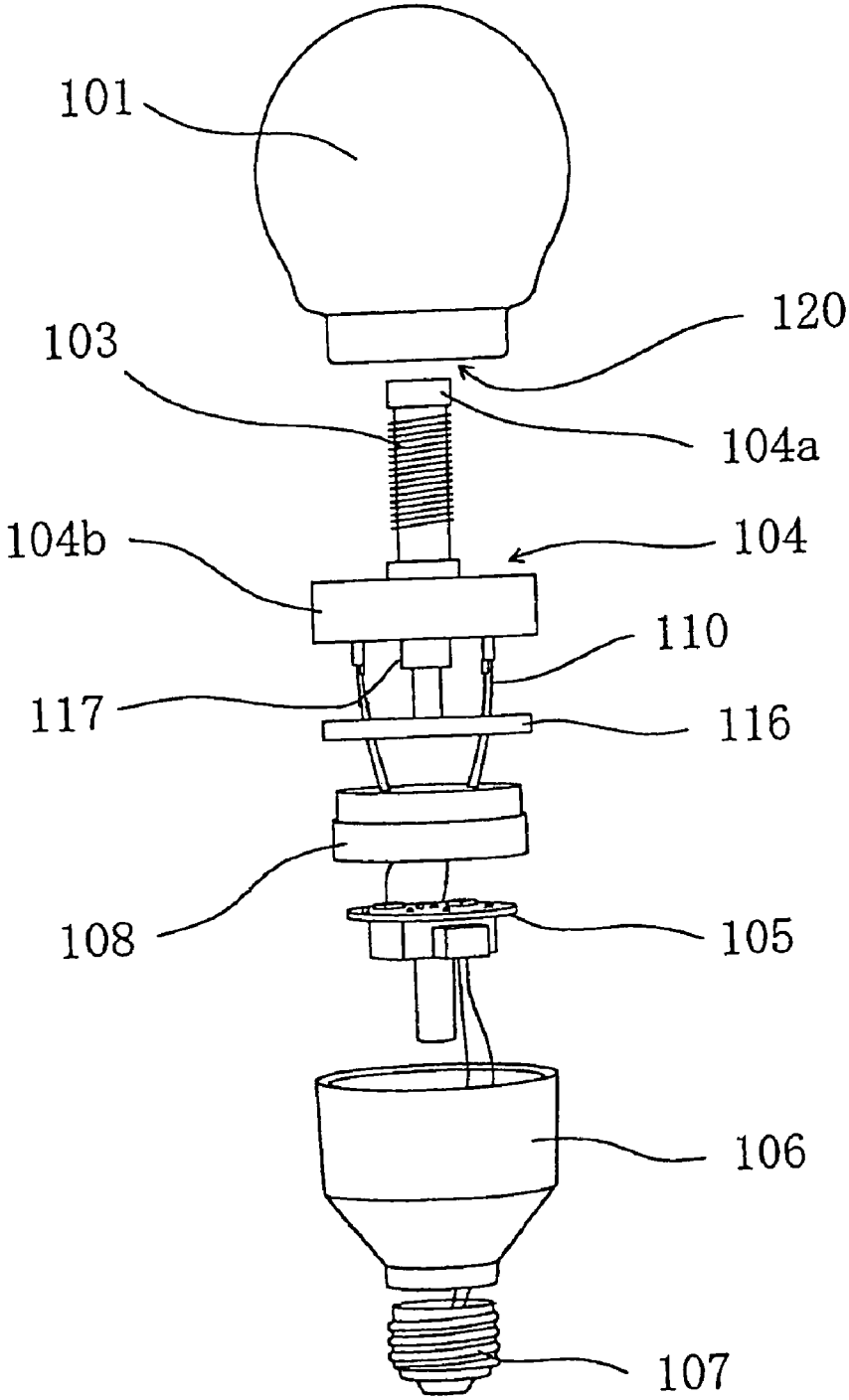
FIG. 5 is an exploded view of the self-ballasted electrodeless fluorescent lamp of the first embodiment.

Next, the outer appearance and configuration of the self-ballasted electrodeless fluorescent lamp of this embodiment will be described with reference to FIGS. 4 and 5.

The external appearance of the self-ballasted electrodeless fluorescent lamp of this embodiment is composed of the luminous bulb 101, the case 106 and the base 107. The case 106 has a threaded structure at one end, and the base 107 with a corresponding threaded structure can be attached to that one end of the case 106. The ferrite core 117 is inserted in the bobbin 104.

In this embodiment, one end of the bobbin 104 is located in the case 106, and a heat sink 116 is attached to that one end of the bobbin 104. The heat sink 116 is, for example, a sheet member with relatively high thermal conductivity (such as metal sheet, ferrite disc.) The heat sink 116 attached to the bobbin 104 suppresses temperature increase in the ferrite core 117. If the ferrite core 117 exceeds the Curie temperature, the ferrite core 117 no longer functions as a magnetic material, so heat dissipation performed by the heat sink 116 can be a critical matter depending on the use conditions.

Furthermore, a circuit holder 108, on which the circuit board 105 can be held, is integrated into the bobbin 104 by interfitting.

Next, it will be briefly described how the self-ballasted electrodeless fluorescent lamp of this embodiment operates. When commercial AC power is supplied to the high frequency power supply via the base 107, the high frequency power supply 105 converts the commercial AC power into high frequency AC power, and supplies the high frequency AC power to the excitation coil 103. The frequency of alternating current supplied by the high frequency power supply is from 50 to 500 kHz, for example, while the power supplied by the high frequency power supply is from 5 to 200 W, for example. Upon receiving the supply of the high frequency AC power, the excitation coil 103 forms a high frequency AC magnetic field in a space close to the excitation coil 103. Then, an induction field occurs perpendicularly with respect to the high frequency AC magnetic field, causing the luminous gas inside the luminous bulb 101 to be excited to emit light. As a result, light emission in the ultraviolet range or the visible range can be obtained. The light emission in the ultraviolet range is changed to light emission (visible light) in the visible range by the phosphor 102 formed on the inner wall of the luminous bulb 101. It should be noted that the lamp can be configured without forming the phosphor 102 so that the light emission in the ultraviolet range (or the light emission in the visible range) is utilized as it is. The light emission in the ultraviolet range is produced mainly from the mercury. More specifically, when a high frequency current is applied to the induction coil 109 located in close vicinity to the luminous bulb 101, an induction field formed by magnetic force lines resulting from the electromagnetic induction causes collision between the mercury atoms and electrons in the luminous bulb 101, whereby ultraviolet light can be obtained from the excited mercury atoms.

Now, the frequency of the alternating current that the high frequency power supply supplies will be described. In this embodiment, the frequency of the alternating current supplied by the high frequency power supply is in a relatively low frequency range at or below 1 MHz (for example, from 50 to 500 kHz), as compared with 13.56 MHz or several MHz in the ISM band generally used in practical applications. The frequency in the low frequency range is used for the following reasons. First, if the lamp is operated in a relatively high frequency range, such as 13.56 MHz or several MHz, the size of a noise filter for suppressing line noise produced by the high frequency power supply is increased, resulting in an increase in the volume of the high frequency power supply. Moreover, if noise radiated or transmitted from the lamp is at high frequency, an expensive shield has to be used in order to meet the requirements of strict regulations specified in the law for high frequency noise, and this becomes a major obstacle in achieving cost reduction. On the other hand, when the lamp is operated in the frequency range from about 50 kHz to about 1 MHz, low-cost general-purpose products that are used as electronic components for general electronic equipment can be used as components of the high frequency power supply 105, and in addition, those components can be small in size. This brings great advantages such as cost reduction and miniaturization. However, the self-ballasted electrodeless fluorescent lamp of this embodiment is not limited to operation at a frequency of 1 MHz or less and is capable of being operated at any frequency in a frequency range, within which 13.56 MHz or several MHz, e.g., fall.

In the configuration of this embodiment, the connection wire 110 that supplies high frequency power to the induction coil 109 is spaced apart from the sealing portion 118 of the inner and outer tubes 120 and 119 of the luminous bulb 101. This prevents occurrence of blackening of the inner wall of the sealing portion 118 when the self-ballasted electrodeless fluorescent lamp is operated.

Furthermore, in this embodiment, the upper end 106*a*, which is part of the case 106, supports and brings upward the luminous bulb 101, such that the connection wire 110 is spaced apart from the sealing portion 118. In this manner, the spacing can be realized easily without causing an increase in the number of components. And if each component has high dimension accuracy, the spacing can be reliably achieved just by attaching the case 106. In this embodiment, the entire upper end 106*a* of the case supports the luminous bulb 101. Nevertheless, part of the case's upper end 106*a* may support the luminous bulb 101, or a supporting member, such as a protrusion, for supporting and bringing upward the luminous bulb 101 may be provided on the inner surface of the case 106. It should be noted that the case 106 and the luminous bulb 101 may each have a fit portion so as to be fitted into each other.

It should be noted that the connection wire 110 that extends from the one end of the excitation coil 103, along the surface of the bobbin's winding rod 104*a* is also preferably spaced apart from the inner wall of the inner tube 120. The distance is preferably 0.3 mm or more.

Moreover, the circuit board 105 may be placed vertically, if the connection wire 110 extends into a region beyond the outer edge of the cavity portion for connection with the circuit board 105, and is spaced apart from the sealing portion 118.

In addition, if the bobbin 104 is employed as in this embodiment, the excitation coil 103 and the ferrite core 117 can be disposed within the inner tube 120 of the luminous bulb 101 just by inserting into the inner tube 120 the bobbin 104 having the excitation coil 103 wound around the winding rod 104*a*, and by inserting the ferrite core 117 into the winding rod 104*a*. This allows the electrodeless fluorescent lamp to be assembled easily. If the bobbin 104 and the luminous bulb 101 are furnished with protrusions, claws, interfitting cavity portions, or the like for firmly securing the bobbin 104 and the luminous bulb 101 to each other, and are held together by interfitting, for example, a relative position between the induction coil 109 and the luminous bulb 101 can be kept constant, even if, e.g., vibration occurs. Moreover, the winding rod 104*a* and the base portion 104*b* are configured as one unit, which suppresses an increase in the number of components.

(Second Embodiment)

Figure 2:
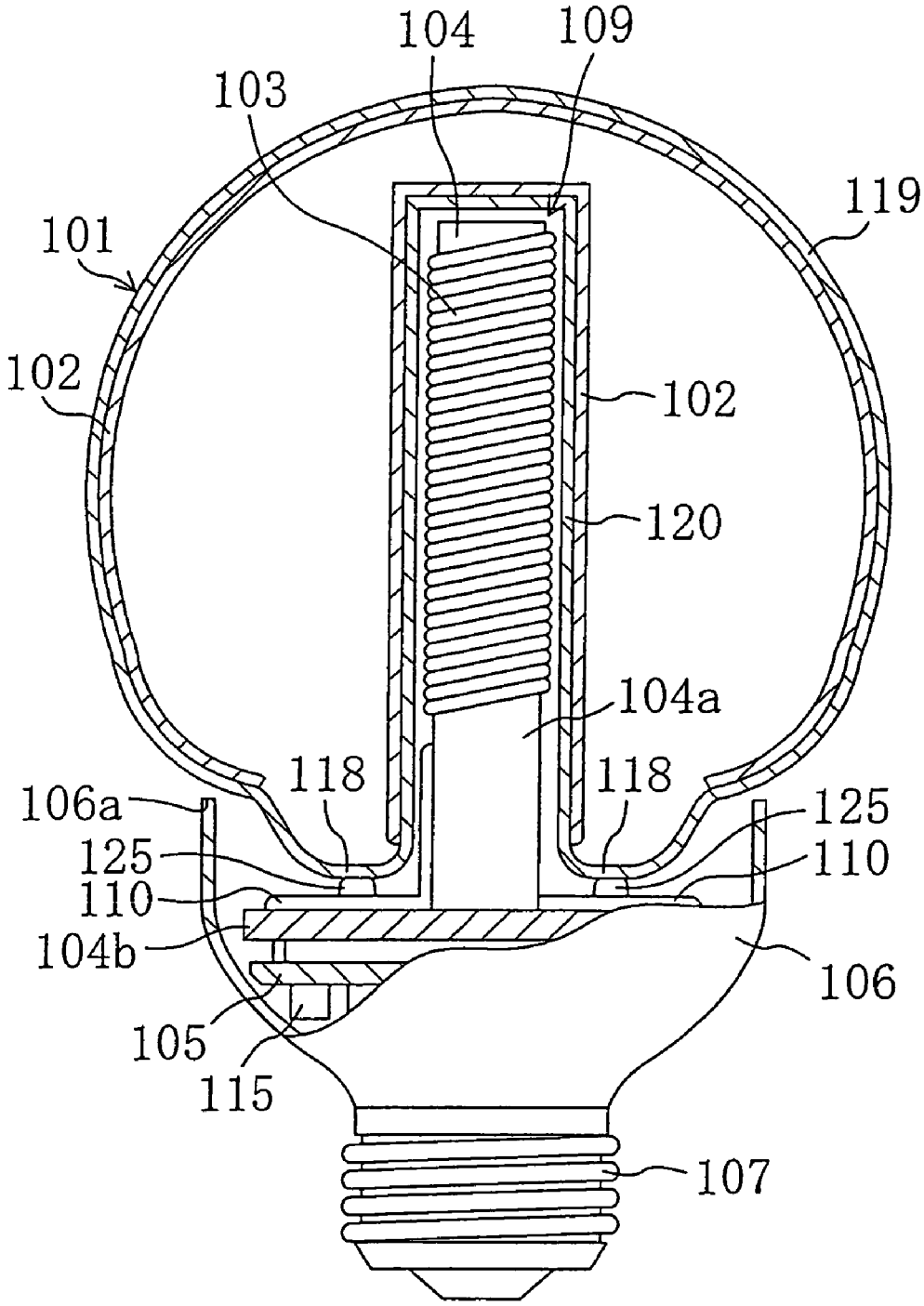
FIG. 2 is a partially cutaway view of a self-ballasted electrodeless fluorescent lamp in accordance with a second embodiment.

With reference to FIG. 2, a self-ballasted electrodeless fluorescent lamp in accordance with a second embodiment of the present invention will be described. The self-ballasted electrodeless fluorescent lamp of this embodiment differs from the lamp of the first embodiment only in terms of configuration for supporting the luminous bulb 101. Therefore, this difference will only be explained.

In this embodiment, a luminous bulb 101 is supported and brought upward by protrusions 125 formed on a base portion 104*b* of a bobbin 104, whereby a connection wire 110 is spaced apart from a sealing portion 118. This structure prevents, as in the first embodiment, occurrence of blacking of the inner wall of the sealing portion 118 when the self-ballasted electrodeless fluorescent lamp is operated. There is a gap between a case's upper end 106*a* and the luminous bulb 101. This gap may be filled with a high-temperature resistant adhesive such as silicon.

The shape and number of protrusions 125 supporting the luminous bulb 101 are not particularly limited. The base portion 104*b* may have a shape in which most part of the base portion 104*b* rises except for its part on which the connection wire 110 extends. Furthermore, the luminous bulb 101 may be supported by both the case's upper end 106*a* and the protrusions 125. The shape of the outer tube 119 is not limited to the A-shape. For example, even if the outer tube 119 is approximately cylindrical in shape, the effects of the present invention can be attained so long as the connection wire 110 extends beyond the sealing portion 118.

While the present invention has been shown in several forms as described in the preferable embodiments thereof, it is not so limited but susceptible of various changes and modifications.

Figure 6:
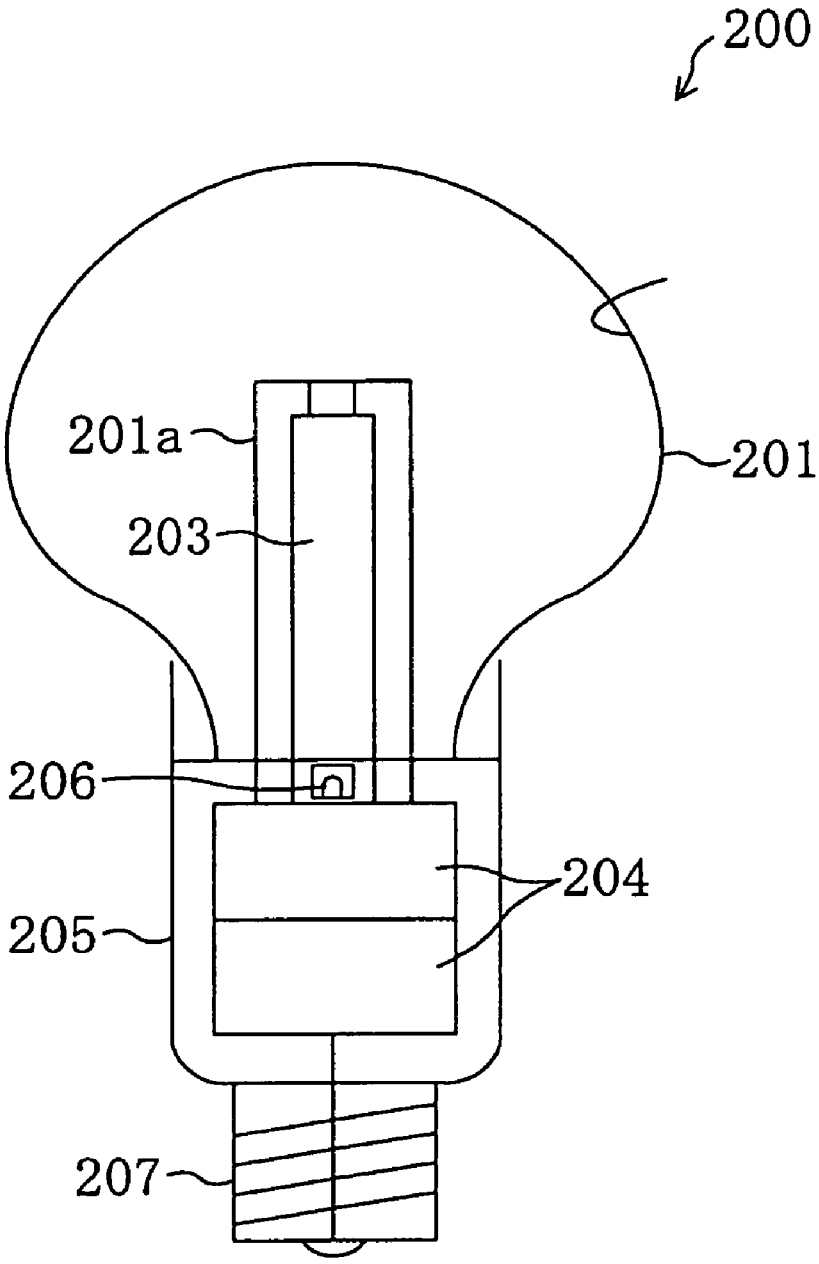
FIG. 6 PRIOR ART
FIG. 6 is a view schematically illustrating a conventional electrodeless fluorescent lamp.

The electrodeless fluorescent lamp disclosed in Japanese Laid-Open Publication No. 10-92391 (see FIG. 6), in which the circuit board is placed vertically (in a direction parallel to the central axis of the luminous bulb) does not serve as a replacement for an incandescent lamp, because the case in which the circuit board is placed is increased in length, such that the electrodeless fluorescent lamp is not close to an incandescent lamp in terms of outer appearance and size. Moreover, because of the vertically placed circuit board, ambient temperature inside the case produced by high temperature plasma within the luminous bulb is almost the same anywhere in the case in spite of difference caused by convention. It is thus difficult to use low heat-resistant circuit elements such as film capacitors.

In the present invention, the circuit board is placed horizontally, and the connection wire of the induction coil is spaced apart from the sealing portion of the inner and outer tubes of the luminous bulb. This allows the lamp to have such size and external appearance as to enable the lamp to become a replacement for an incandescent lamp, while suppressing blackening of the sealing portion.

Industrial Applicability

According to the present invention, by a simple structure, an electrodeless fluorescent lamp that has almost the same size and external appearance as those of an incandescent lamp can be obtained, and blackening of a sealing portion can be prevented. Accordingly, the present invention has a high industrial applicability in application of long-life self-ballasted electrodeless fluorescent lamps that can replace incandescent lamps.

What is claimed is:

1. A self-ballasted electrodeless fluorescent lamp, comprising:

a luminous bulb in which a luminous gas containing at least mercury is enclosed and which has a cavity portion;

an induction coil inserted in the cavity portion;

a circuit board electrically connected to the induction coil;

a case in which the circuit board is placed; and a base attached to the case and electrically connected to the circuit board; and a bobbin including a winding rod, around which the induction coil is wound, and a base portion, which is placed approximately at a right angle with respect to the winding rod and which supports the winding rod, wherein a ballast circuit for supplying high frequency power to the induction coil is formed on the circuit board;

the luminous bulb includes an approximately spherical outer tube and an inner tube defining the cavity portion;

the circuit board is placed approximately horizontally when a central axis of the inner tube is placed vertically;

a connection wire for electrically connecting the induction coil and the circuit board extends from one end of the induction coil into a region beyond an outer edge of the cavity portion, and is connected to the circuit board; and the connection wire is placed so as to be spaced apart from a sealing portion of the outer and inner tubes;

the winding rod of the bobbin is inserted in the cavity portion;

the base portion of the bobbin is disposed between the luminous bulb and the circuit board;

the connection wire extends from the one end of the induction coil so as to pass on or above a surface of the base portion which is located close to the luminous bulb; and protrusion, which supports part of the luminous bulb in such a manner as to lift the luminous bulb in a direction opposite to the base, is formed on the base portion, which allows the connection wire to be disposed spaced apart from the sealing portion.

2. The self-ballasted electrodeless fluorescent lamp of claim 1, wherein part of the case supports part of the luminous bulb, and the structure in which the connection wire is disposed spaced apart from the sealing portion is realized by lifting with the case the luminous bulb in a direction opposite to the base.

3. The self-ballasted electrodeless fluorescent lamp of claim 1, wherein a film capacitor, which is a circuit element included in the ballast circuit, is disposed on a surface of the circuit board which is located close to the base.

4. The self-ballasted electrodeless fluorescent lamp of claim 1, wherein the greatest length of the circuit board is 60 mm or less.

5. The self-ballasted electrodeless fluorescent lamp of claim 1, wherein a phosphor or a protective coating is not applied to an inner wall of the sealing portion.

6. A self-ballasted electrodeless fluorescent lamp, comprising:

a luminous bulb in which a luminous gas containing at least mercury is enclosed and which has a cavity portion;

an induction coil inserted in the cavity portion;

a circuit board electrically connected to the induction coil;

a case in which the circuit board is placed; and a base attached to the case and electrically connected to the circuit board, wherein a ballast circuit for supplying high frequency power to the induction coil is formed on the circuit board;

the luminous bulb includes an outer tube and an inner tube defining the cavity portion;

the circuit board is provided with output terminals to the induction coil and input terminals from the base;

the output and input terminals are disposed so as to be separate from each other by 15 mm or more;

a connection wire for electrically connecting the induction coil and the circuit board extends from one end of the induction coil into a region beyond an outer edge of the cavity portion, and is connected to the circuit board; and the connection wire is placed so as to be spaced apart from a sealing portion of the outer and inner tubes.

7. A self-ballasted electrodeless fluorescent lamp comprising:

a luminous bulb in which a luminous gas containing at least mercury is enclosed and which has a cavity portion;

an induction coil inserted in the cavity portion;

a circuit board electrically connected to the induction coil;

a case in which the circuit board is placed; and a base attached to the case and electrically connected to the circuit board; and wherein a ballast circuit for supplying high frequency power to the induction coil is formed on the circuit board;

the luminous bulb includes an approximately spherical outer tube and an inner tube defining the cavity portion;

the circuit board is placed approximately horizontally when a central axis of the inner tube is placed vertically;

a connection wire for electrically connecting the induction coil and the circuit board extends from one end of the induction coil into a region beyond an outer edge of the cavity portion, and is connected to the circuit board;

the connection wire is placed so as to be spaced apart from a sealing portion of the outer and inner tubes;

part of the case supports part of the luminous bulb; and the structure in which the connection wire is disposed spaced apart from the sealing portion is realized by lifting with the case the luminous bulb in a direction opposite to the base.

8. A self-ballasted electrodeless fluorescent lamp, comprising:

a luminous bulb in which a luminous gas containing at least mercury is enclosed and which has a cavity portion;

an induction coil inserted in the cavity portion;

a circuit board electrically connected to the induction coil;

a case in which the circuit board is placed;

a base attached to the case and electrically connected to the circuit; and a bobbin including a winding rod, around which the induction coil is wound, and a base portion, which is placed approximately at a right angle with respect to the winding rod and which supports the winding rod, wherein a ballast circuit for supplying high frequency power to the induction coil is formed on the circuit board;

the luminous bulb includes an outer tube and an inner tube defining the cavity portion;

the circuit board is provided with output terminals to the induction coil and input terminals from the base;

the output and input terminals are disposed so as to be separate from each other by 15 mm or more;

a connection wire for electrically connecting the induction coil and the circuit board extends from one end of the induction coil into a region beyond an outer edge of the cavity portion, and is connected to the circuit board;

the connection wire is placed so as to be spaced apart from a sealing portion of the outer and inner tubes;

the winding rod of the bobbin is inserted in the cavity portion;

the base portion of the bobbin is disposed between the luminous bulb and the circuit board;

the connection wire extends from the one end of the induction coil so as to pass on or above a surface of the base portion which is located close to the luminous bulb; and a protrusion, which supports part of the luminous bulb in such a manner as to lift the luminous bulb in a direction opposite to the base, is formed on the base portion, which allows the connection wire to be disposed spaced apart from the sealing portion.

9. The self-ballasted electrodeless fluorescent lamp of claim 6, wherein the connection wire and the sealing portion are spaced apart from each other by 0.3 mm or more.

10. The self-ballasted electrodeless fluorescent lamp of claim 6, wherein the greatest length of the circuit board is 60 mm or less.

11. The self-ballasted electrodeless fluorescent lamp of claim 6, wherein a phosphor or a protective coating is not applied to an inner wall of the sealing portion.

* * * * *

UNITED STATES PATENT AND TRADEMARK OFFICE

CERTIFICATE OF CORRECTION

PATENT NO. : 7,088,056 B2
APPLICATION NO. : 10/506445
DATED : August 8, 2006
INVENTOR(S) : Toshiaki Kurachi et al.

It is certified that error appears in the above-identified patent and that said Letters Patent is hereby corrected as shown below:

| Column | Line | Claim | Description |
|---|---|---|---|
| 12 | 21 | 1 | Before “protrusion”. insert --a-- |
| 12 | 27 | 2 | Delete “part” and insert --an upper end-- |
| 12 | 28 | 2 | After “bulb”, delete remainder of claim and insert --in such a manner as to lift the luminous bulb in a direction opposite to the base, thereby allowng the connection wire to be disposed spaced apart from the sealing portion.-- |
| 12 | 38 | 4 | After “wherein the”, delete remainder of claim and insert --connection wire and the sealing portion are spaced apart from each other by 0.3 mm or more.-- |
| 12 | 41 | 5 | After “wherein”, delete remainder of claim and insert --the greatest length of the circuit board is 60 mm or less.-- |
| 12 | 43 | 6 | After “lamp”, delete remainder of claim and insert --of claim 1, wherein a phosphor or a protective coating is not applied to an inner wall of the sealing portion.-- |
| 13 | 41 | 8 | After “circuit”, insert --board-- |
| 14 | 34 | 9 | Delete “claim 6” and insert --claim 8-- |
| 14 | 37 | 10 | Delete “claim 6” and insert --claim 8-- |
| 14 | 40 | 11 | Delete “claim 6” and insert --claim 8-- |

Signed and Sealed this

Twenty-sixth Day of December, 2006

JON W. DUDAS
*Director of the United States Patent and Trademark Office*